US005904445A

United States Patent [19]

Meuth

[11] Patent Number: 5,904,445

[45] Date of Patent: May 18, 1999

[54] UMBILICAL LINE STAND-OFF ASSEMBLY FOR MARINE RISER ASSEMBLY

[75] Inventor: Thomas Larry Meuth, Spring, Tex.

[73] Assignee: Offshore Clamp & Protector Technologies, Inc., Spring, Tex.

[21] Appl. No.: 08/876,792

[22] Filed: Jun. 16, 1997

[51] Int. Cl.[6] ..... E02B 11/38

[52] U.S. Cl. ..... 405/195.1; 24/29; 24/278; 24/282; 166/359; 403/397; 405/224

[58] Field of Search ..... 405/195.1; 166/350, 166/359, 367; 24/278, 282, 26, 27, 28, 29; 256/47, 48, 54, 57; 403/397

[56] References Cited

U.S. PATENT DOCUMENTS

| | | | |
|---|---|---|---|
| 464,338 | 12/1891 | Crisp | 24/29 |
| 996,478 | 6/1911 | Francis | 24/29 |
| 1,471,386 | 10/1923 | Crockett | 24/282 X |
| 1,834,838 | 12/1931 | Hingley . | |
| 2,009,046 | 7/1935 | Fons | 24/278 X |
| 2,107,407 | 2/1938 | Burton | 189/36 |
| 3,716,897 | 2/1973 | Renaud | 24/29 |
| 4,059,872 | 11/1977 | Delesandri | 24/284 |
| 4,414,715 | 11/1983 | Anjos et al. | 24/27 X |
| 4,437,791 | 3/1984 | Reynolds | 405/195 |
| 4,492,393 | 1/1985 | Schaub | 24/283 X |
| 4,566,819 | 1/1986 | Johnston | 403/385 |
| 4,632,221 | 12/1986 | Stanford | 182/179 |
| 4,657,284 | 4/1987 | Fiori | 24/20 S X |
| 4,852,840 | 8/1989 | Marks | 24/278 X |
| 5,307,790 | 5/1994 | Byrne | 24/20 R |
| 5,598,995 | 2/1997 | Meuth et al. | 248/74.3 |

OTHER PUBLICATIONS

Composite Catalog of Oil Field Equipment and Services for years 1976–1977, published by World Oil, pp. 1370 and 5345.

*Primary Examiner*—Dennis L. Taylor
*Attorney, Agent, or Firm*—Akin, Gump, Strauss, Hauer & Feld, L.L.P.

[57] ABSTRACT

A stand-off assembly to attach to a cylindrical support member. The stand-off assembly includes a first component having a first arcuate portion adapted to conform to an outer surface of the cylindrical support member. The first component has a first attachment upright. A second component has a second arcuate portion adapted to conform to the outer surface of the cylindrical support member and also includes a second attachment upright. The second component is connected to the first component with a hinge connection. The first and second arcuate portions in combination extend substantially around the cylindrical support member and the first and second attachment uprights are parallel but separated from each other when the first and second arcuate portions are extended substantially around the cylindrical support member.

12 Claims, 4 Drawing Sheets

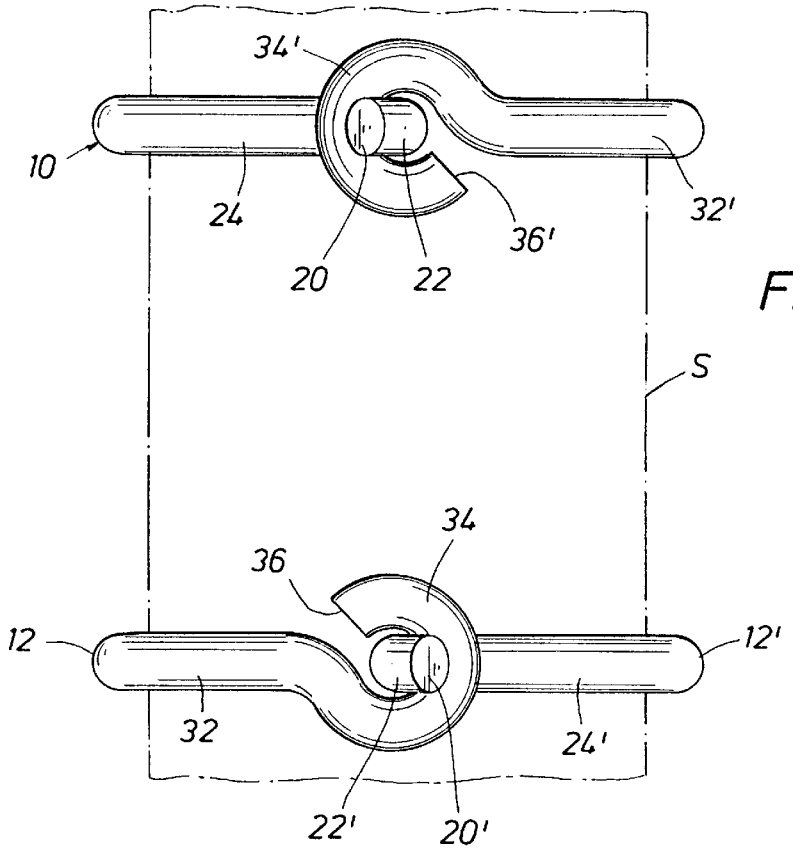
FIG. 5
FIG. 6
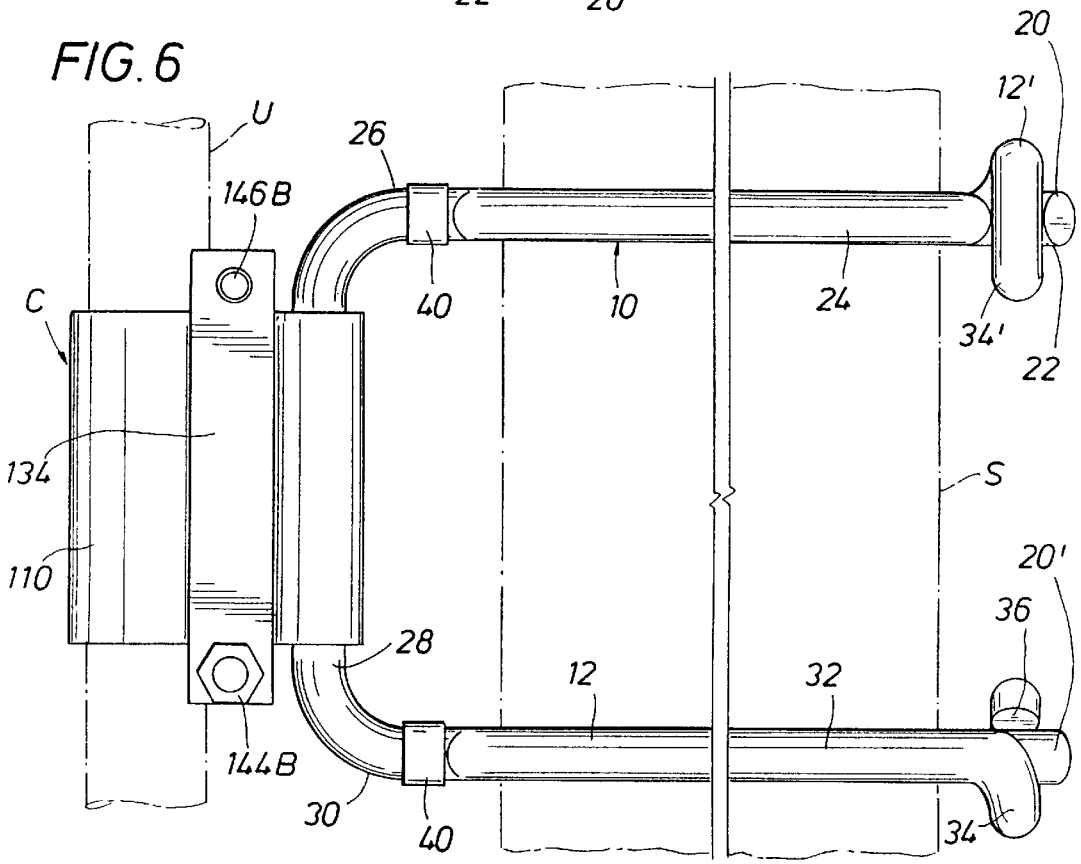

UMBILICAL LINE STAND-OFF ASSEMBLY FOR MARINE RISER ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates generally to stand-off assemblies secured to a support member for securing another member thereto. The present invention is particularly adapted for use as a stand-off assembly to attach an umbilical line to a choke or kill line in a marine riser assembly.

2. Description of the Related Art

The need often arises for one elongate member to be secured longitudinally to an elongate support member. This situation often occurs where an umbilical line is required to be secured to a support member or pipe at a certain distance away from the support member. The umbilical line may be a cable, hose or pipe which is run along the length of the support member or pipe.

In the offshore drilling and production industry, it is frequently necessary to run umbilical lines hundreds and even thousands of feet below the support vessel or drilling or production platform down to the sea floor and beyond. Typically, umbilical lines (commonly called control lines) are hydraulic, electric, or fiber optic and they are often separate lines. When the umbilical lines are bundled together in any combination into a single line they are referred to as multiplex control lines or multiplex control cables. These control lines are normally clamped to both the choke line and the kill line on the subsea marine drill riser assembly. Also the control lines are often sent subsea by clamping onto wire lines, drill pipes, casing, and any other available support members. Due to the high cost of working in such environments and serious concerns over loss of functions in a control line, it is critical that the umbilical line be securely attached to the support member to prevent costly consequences, such as loss of signal in a fiber optic cable due to slack in an umbilical line which can create a sharp radius in the line preventing signal transmission. Various types of clamp assemblies and stand-off assemblies have been used in these situations. The prior art clamp assemblies and stand-off assemblies have been very costly and time consuming to make, use and install, and many do not clamp the umbilical lines with enough force.

Applicant's co-pending patent application Ser. No. 08/814,434 entitled "ULTRA HIGH STRENGTH CLAMP ASSEMBLY" discloses an ultra high strength clamp assembly having a flexible strap with first and second ends. The flexible strap extends substantially around the umbilical line and support member and is secured around the umbilical line and support member. The first and second ends are adapted to be coupled to each other or to the support member or to be wrapped twice around the two members resulting in no buckle or attachment being required. The ultra high strength clamp assembly also includes a tensioner assembly having first and second tensioner bars spaced parallel to one another. Each of the first and second tensioner bars includes a bullnose face and the bullnose faces are in opposing relationship to one another. The tensioner assembly also includes an adjusting member for adjusting the spacing between the first and second tensioner bars. The flexible strap extends twice through the space between the first and second tensioner bars, which encloses around the umbilical line. In use, the first and second tensioner bars are situated substantially between the umbilical line and the support member. Applicant herein incorporates by reference U.S. patent application Ser. No. 08/814,434.

As stated above, it is often required that the umbilical line be maintained a certain distance away from the support member. A stand-off assembly is then used to maintain the required distance between the support member and the umbilical line. It is important the stand-off assembly be securely fastened to the support member and also that the umbilical line can be securely attached to the stand-off assembly. In the past, various types of welded stand-off assemblies have been connected to the support member, usually by bolting the stand-off assembly to the support member.

Weight considerations are very important in the design of subsea marine riser assemblies. The greater the weight of the marine riser assembly the more compensation required. Typically, the marine riser assembly includes flotation foam to compensate for the submerged weight of the riser assembly. In very deep water applications, it costs approximately $5.00 for the amount of flotation foam necessary to compensate for each additional pound added to the riser assembly.

It is desirable to have a stand-off assembly that is easy to install, lightweight, has high strength, and is economical to fabricate and install. It is also desirable that the stand-off assembly be adapted for use with applicant's ultra high strength clamp assembly as disclosed in patent application Ser. No. 08/814,434.

BRIEF SUMMARY OF THE INVENTION

The present invention is a stand-off assembly that is easy to install, lightweight, has high strength, and is economical to fabricate and install. The stand-off assembly is also adapted for use with applicant's ultra high strength clamp assembly as disclosed in patent application Ser. No. 08/814,434.

The stand-off assembly includes a first component having a first arcuate portion adapted to conform to an outer surface of the cylindrical support member. The first component has a first attachment upright. A second component has a second arcuate portion adapted to conform to the outer surface of the cylindrical support member and also includes a second attachment upright. The second component is connected to the first component with a hinge connection. The first and second arcuate portions in combination extend substantially around the cylindrical support member and the first and second attachment uprights are parallel but separated from each other when the first and second arcuate portions are extended substantially around the cylindrical support member. A band clamp can be installed around the components to draw the attachment uprights toward each other and ensure a tight, secure fit of the stand-off assembly to the support member.

BRIEF DESCRIPTION OF THE VIEWS OF THE DRAWINGS

In order to more fully understand the drawings referred to in the detailed description of the present invention, a brief description of each drawing is presented, in which:

FIG. 5 is a rear elevational view of the stand-off assembly;

FIG. 6 is a side elevational view of the stand-off assembly showing the umbilical line clamped to the stand-off assembly;

DETAILED DESCRIPTION OF THE INVENTION

Figure 1:
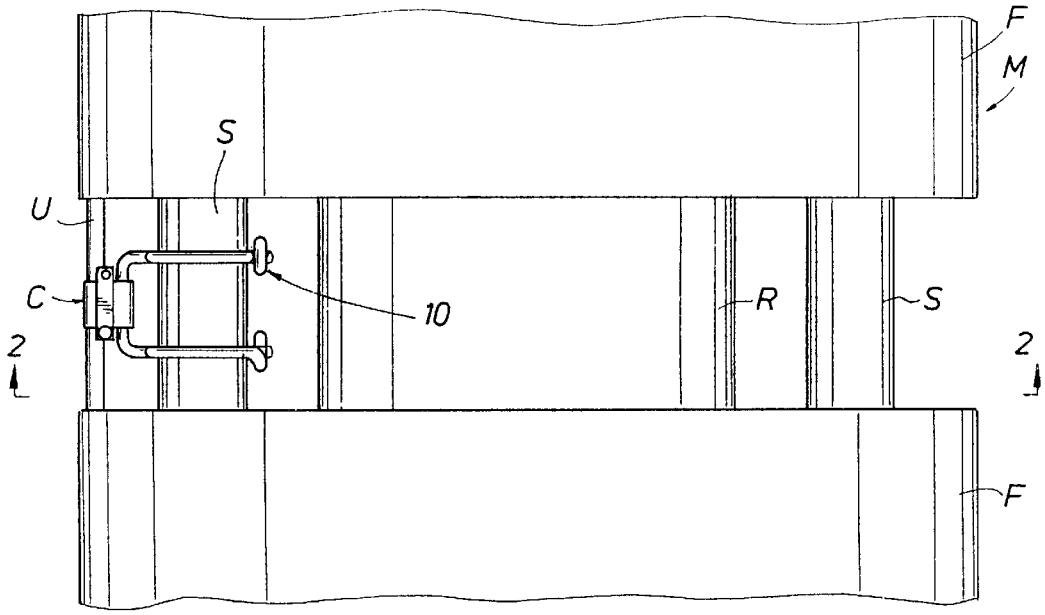
FIG. 1 is a side elevational view of a portion of a marine riser assembly having flotation foam surrounding a riser, choke and kill lines and an umbilical line securely clamped to a stand-off assembly according to the preferred embodiment of the present invention.
Figure 2:
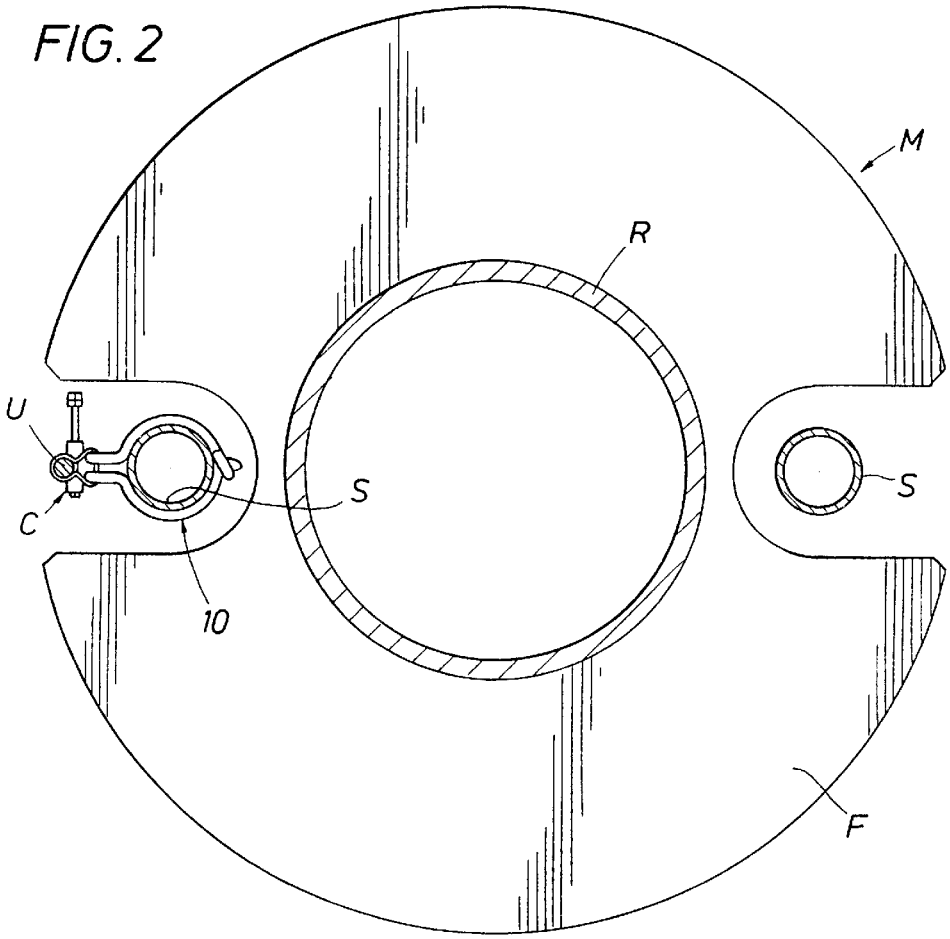
FIG. 2 is a view taken along line 2—2 of FIG. 1.

With reference to the drawings, the stand-off assembly, generally designated as 10, will now be described in greater detail. The stand-off assembly 10 of the present invention is shown and described with reference to a marine riser assembly M as shown in FIGS. 1 and 2. It is to be understood that the stand-off assembly 10 is not limited to use on a marine riser assembly M but can be used in a variety of applications where it is necessary to secure one elongate member to an elongate support member with a certain distance therebetween.

Referring to FIGS. 1 and 2, the typical marine riser assembly M has choke and kill lines S mounted opposite one another on the opposite sides of a riser pipe R. The choke and kill lines S are typically pipes of identical size and will be referred to as support members or pipes S. As shown in FIGS. 1 and 2, the marine riser assembly M oftentimes has flotation foam F around the periphery of the riser pipe R to provide buoyant forces to the marine riser assembly M. The flotation foam F generally surrounds the riser pipe R. Typically, the flotation foam F has a generally circular cross-section and is shaped to allow spaces for the support members S (i.e. choke and kill lines) to be attached to the riser pipe R. There is typically adequate clearance allowed between the flotation foam F and the support member S to provide access to an area to secure an umbilical line U to the support member S. Typically, it is desirable for the umbilical line U to be secured to the support member S at a certain distance from the support member S while remaining within the generally circular cross-section of the flotation foam F as shown in FIGS. 1 and 2. The umbilical line U is secured to the support member S via the stand-off assembly 10 and a clamp assembly C as will be explained below.

The stand-off assembly 10 will now be described in greater detail with reference to FIGS. 3–8. The stand-off assembly 10 is preferably of two piece construction with the two components identical in size and shape. The stand-off components will be referred to as 12 and 12'. It is to be understood that the stand-off assembly 10 is not limited to two piece construction of identical size and shape, but it can also be made in similar ways without departing from the scope of the present invention. By making the components 12 and 12' identical the cost to manufacture is reduced and the installation of the stand-off assembly 10 is simplified.

The stand-off assembly 10 is sized and shaped to closely fit around the outer diameter of the support member S as shown in FIGS. 3–8. Preferably, each stand-off component 12, 12' is formed of round bar stock. The diameter of the bar stock will depend upon the amount of required stiffness and force the stand-off assembly 10 will be subjected to. It is anticipated that ⅝ths inch diameter bar stock will be very suitable for many deepwater marine riser assembly applications. It is to be understood that like features of the stand-off component 12' are denoted by the same number as used below followed by a prime (').

Figure 4:
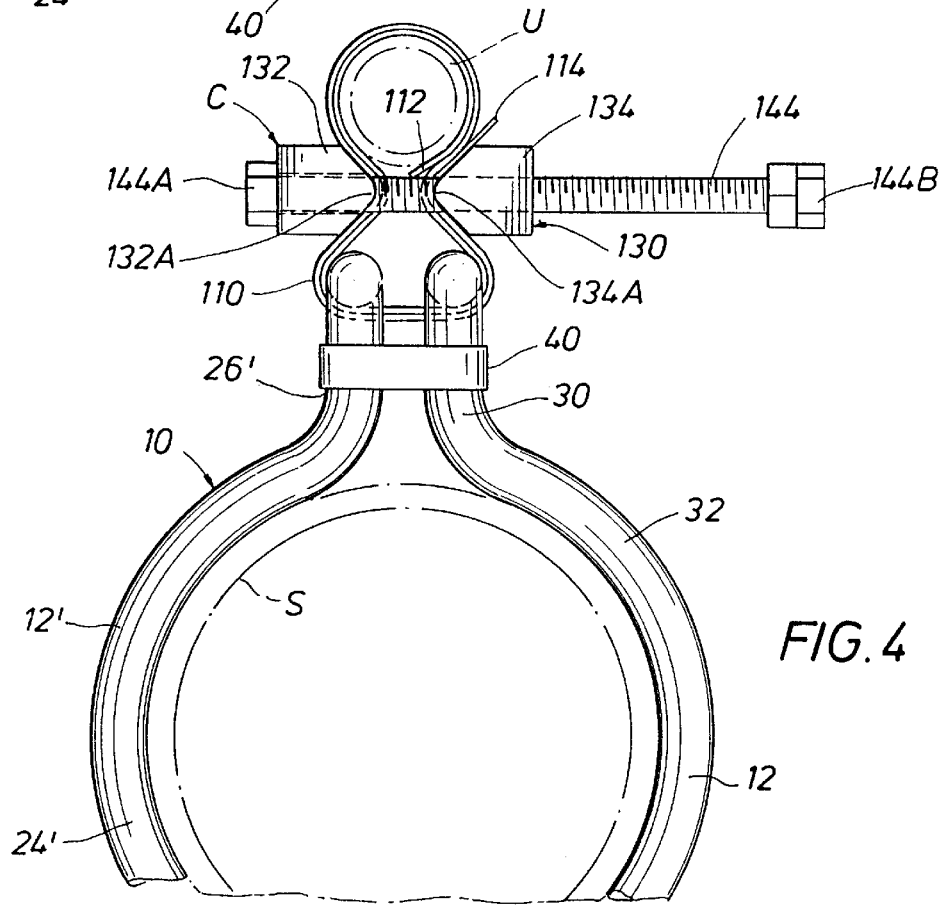
FIG. 4 is a partial top plan view of the stand-off assembly.
Figure 7:
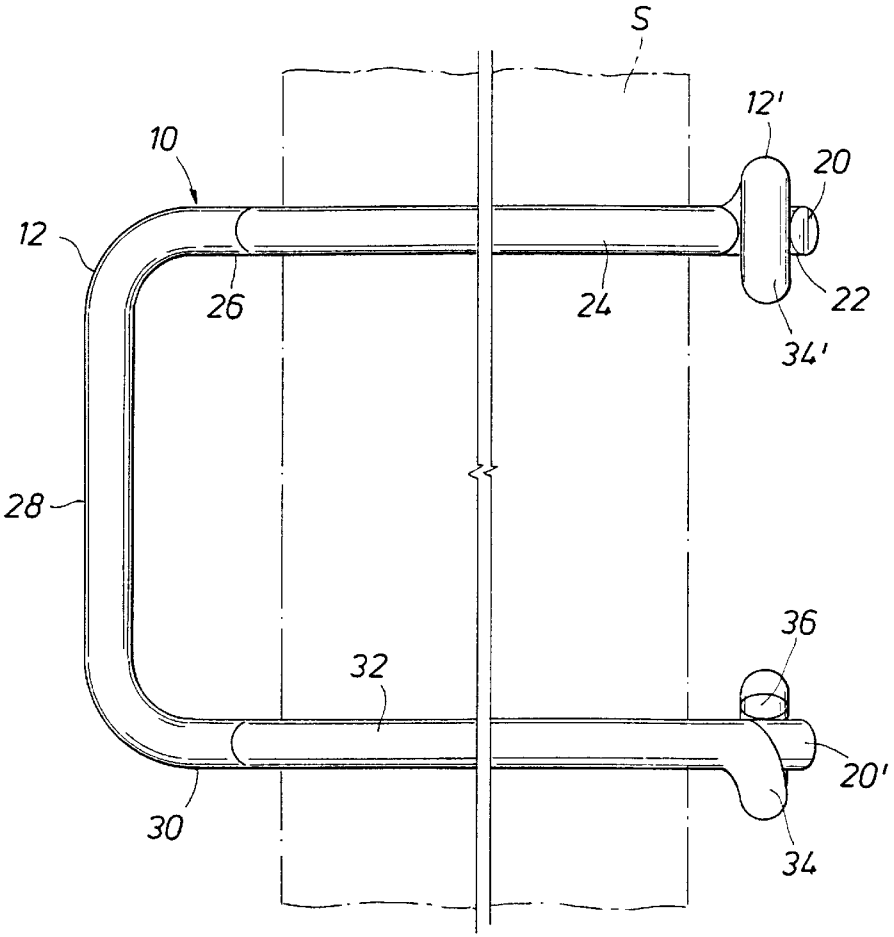
FIG. 7 is a side elevational view of the stand-off assembly with the umbilical line and clamp assembly removed for clarity.

Referring to FIGS. 4 and 7, the stand-off component 12 includes a first end 20 having a rear outturned bend portion 22 and a first arcuate portion 24 (FIG. 4). The first arcuate portion 24 is preferably formed having an inside radius of curvature substantially corresponding to the outside radius of the support member S and forms an arc less than 180 degrees. A first leg portion 26 extends outwardly from the first arcuate portion 24 as shown in FIG. 4. An attachment upright 28 extends from the first leg portion 26. Preferably, the attachment upright 28 is transverse to the plane of the first arcuate portion 24 as shown in FIG. 7. Still referring to FIG. 7, a second leg portion 30 extends from the attachment upright 28 to a second arcuate portion 32. The second arcuate portion 32 is the same size and shape as the first arcuate portion 24. Similarly, the second leg portion 30 is the same length as the first leg portion 26 so that the attachment upright 28 is substantially parallel to the longitudinal axis of the support member S when the stand-off assembly 10 is mounted on the support member S as shown in FIG. 7. It is to be understood that the length of the leg portions 26 and 30 will be determined based on the distance that the umbilical line U is desired to be from the support member S. The stand-off component 12 includes an eyelet 34 at a second end 36.

Figure 3:
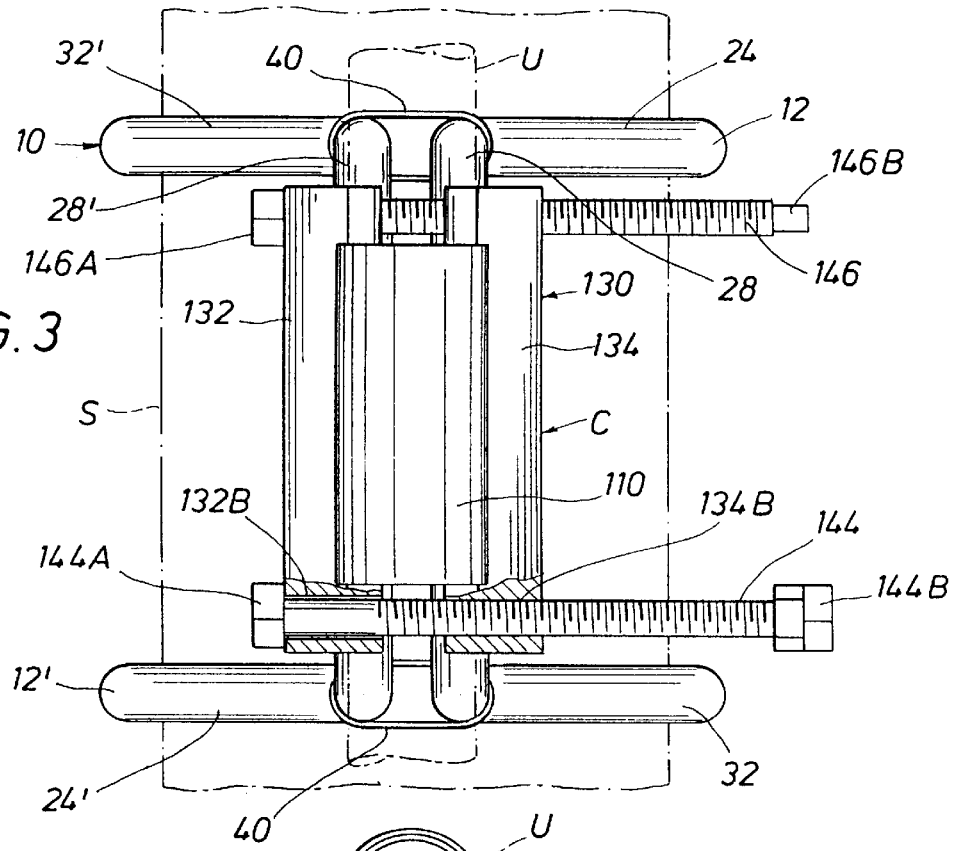
FIG. 3 is a front elevational view of the stand-off assembly of FIG. 1 showing the umbilical line, choke/kill line, and the clamp assembly.

Referring to FIG. 5, the stand-off components 12 and 12' are joined together by inserting the rear outturned bend portions 22 and 22' through the eyelets 34' and 34, respectively. Referring to FIG. 3, the attachment uprights 28 and 28' are brought toward each other around the support member S. The arcuate portions 24, 24', 32 and 32' are brought into contact with support member S which prevents the attachment uprights 28 and 28' from coming into contact with each other (see FIGS. 3 and 4). Referring to FIGS. 3 and 4, a band clamp 40 can be tightly secured around the leg portions 26' and 30 to secure the stand-off assembly 10 to the support member S. Additionally or alternatively, a second band clamp 40 can be tightly secured around the leg portions 26 and 30' to secure the stand-off assembly 10 to the support member S. While not shown in the drawings, the band clamp 40 could alternatively be tightly secured around the attachment uprights 28 and 28'. The band clamps 40 are preferably made of metal and may include a variety of band-type clamps which are known to those of ordinary skill in the art.

It is to be understood that the use of one or more band clamps 40 is optional but is deemed preferred to maintain the stand-off assembly 10 in place while the ultra high strength clamp assembly C is installed to secure the umbilical line U to the stand-off assembly 10.

FIGS. 3, 4 and 6 show an ultra high strength clamp assembly, generally designated as C, as disclosed in Applicant's co-pending U.S. patent application Ser. No. 08/814,434. The ultra high strength clamp assembly C, comprises a strap 110, preferably flexible, having first and second ends 112 and 114, respectively, and a tensioner assembly 130 as shown in FIGS. 3 and 4.

Referring to FIG. 4, the flexible strap 110 has a length sufficient to allow the strap 110 to extend approximately twice around the umbilical line U and attachment uprights 28 and 28' to essentially form a "double wrap" around the umbilical line U and attachment uprights 28 and 28'. Although not shown, preferably the second end 112 and a medial portion include hook and loop type fasteners attached thereto. The medial portion and the second end 112 are adapted to be coupled to each other with the hook and loop type fasteners after the strap 110 has formed the double wrap around the members U and S.

The tensioner assembly 130 includes first and second tensioner bars 132 and 134, respectively, and first and second adjusting members 144 and 146, respectively. The first tensioner bar 132 has an upper bore (not shown) and a lower bore 132B. The second tensioner bar 134 has an upper bore (not shown) having a threaded portion and a lower bore 134B having a threaded portion.

Referring to FIG. 3, the adjusting members 144 and 146 include a drive portion 144A and 146A, respectively. The first adjusting member 144 is inserted through the lower bore 132B and threadedly received within the lower bore 134B. Similarly, the second adjusting member 146 is inserted through the upper bore of the first tensioner bar 132 and threadedly received in the upper bore of the second tensioner bar 134. The first adjusting member 144 preferably includes a pair of jam nuts 144B threaded thereon to prevent the first adjusting member 144 from becoming unthreaded from the second tensioner bar 134. Preferably, the second adjusting member 146 includes a reduced diameter end portion 146B which serves to guide the end portion 146B into the threaded upper bore of the second tensioner bar 134 and provide a quick start for the threaded connection as will be explained below. The first and second adjusting members 144 and 146 serve to adjust the spacing between the tensioner bars 132 and 134. Referring to FIG. 4, the tensioner bars 132 and 134 include bullnose faces 132A and 134A, respectively.

It is to be understood that the ultra high strength clamp assembly C relies on frictional contact of the double wrap of the flexible strap 110 around the umbilical line U and attachment uprights 28. The frictional contact of the strap 110 with the umbilical line U and attachment uprights 28 and the frictional contact between the wraps of the strap 110 provide greater holding capacity. It is also to be understood that further wraps of the strap 110 will provide additional strength and frictional force.

The securing of the umbilical line U to the stand-off assembly 10 with the ultra high strength clamp assembly C will now be described in detail. The stand-off assembly 10 is secured to the support member S as described above. The first and second adjusting members 144 and 146 of the clamp assembly C are unscrewed so that the jam nuts 144B of the first adjusting member 144 contact the second tensioner bar 134 and the second adjusting member 146 is unscrewed from the second tensioner bar 134. The double wrap of the flexible strap 110 is formed around the umbilical line U and attachment uprights 28 (FIG. 4) and the hook and loop type fasteners (not shown) join the second end 112 to the medial portion to temporarily hold the strap 110 in place while the tensioner assembly 130 is installed. Since the top of the tensioner assembly 130 is now open due to the removal of the second adjusting member 146, the tensioner assembly 130 can now be placed between the umbilical line U and attachment uprights 28 very easily and quickly. The second adjusting member 146 is inserted through the first tensioner bar 132 and the reduced diameter end portion 146B serves to guide the end portion 146B into the threaded upper bore of the second tensioner bar 134 and provide a quick start for the threaded connection. Both of the first and second adjusting members 144 and 146, respectively, are drawn tight to firmly secure the ultra high strength clamp assembly C to the umbilical line U and attachment uprights 28.

It is also to be understood that the strap 110 is prevented from coming free or loose from around the umbilical line U and attachment uprights 28 when the tensioner assembly 130 is secured in place, unless the tensioner assembly 130 is released or the strap 110 fails.

It is also to be understood that the tightening of the tensioner assembly 130 also serves to draw the attachment uprights 28 toward each other. This serves to tightly secure the stand-off assembly 10 to the support member S either with or without the band clamps 40. The end result is that the umbilical line U is tightly secured to the stand-off assembly 10 and the stand-off assembly 10 is tightly secured to the support member S.

Additionally, it is to be understood that the hinged connection of the stand-off components 12 and 12' due to the eyelets 34, 34' and rear outturned bend portions 22', 22 enables the stand-off assembly 10 to be installed around support members S at a point along the length of the support member S without having to slide the stand-off assembly 10 over the end of the support member S. The two-piece construction of the stand-off assembly 10 also enables the assembly in areas of minimal spatial access around the support member S.

Figure 8:
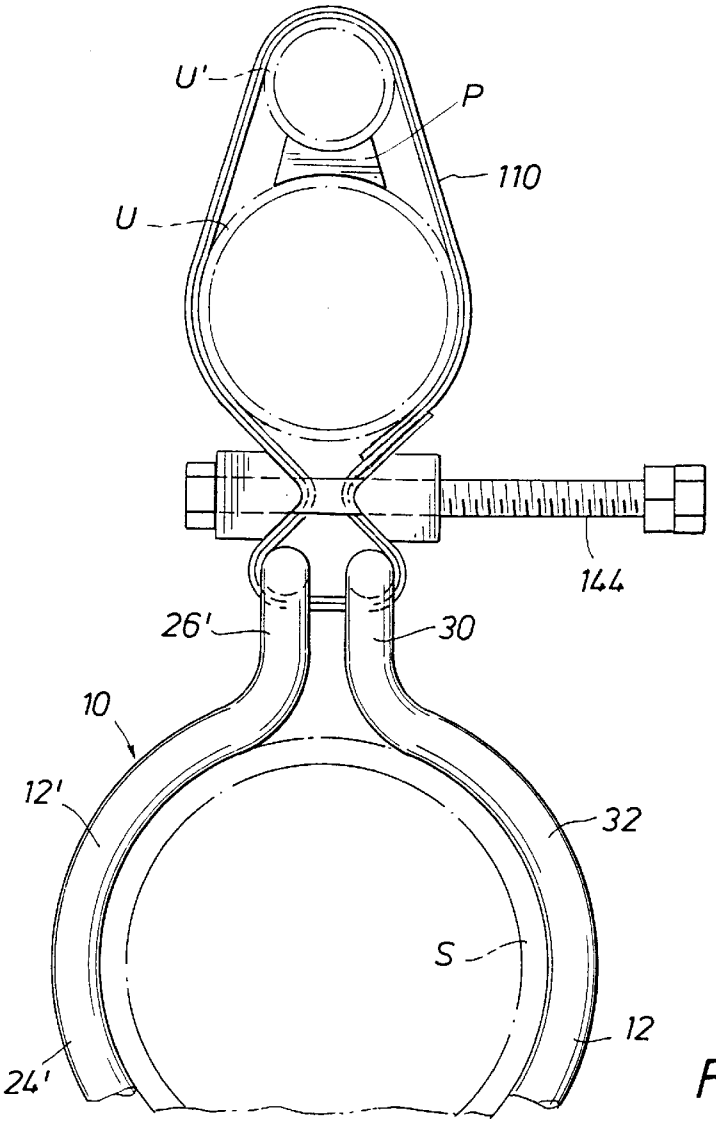
FIG. 8 is a view similar to FIG. 4 showing the stand-off assembly being used to support a plurality of umbilical lines.

The stand-off assembly 10 of the present invention can also be used to support more than one umbilical line as shown in FIG. 8. In FIG. 8, the stand-off assembly 10 mounts to the support member S in the same manner as described above. The flexible strap 110 extends around the attachment uprights 28 and 28' and the umbilical members U and U'. Preferably, the umbilical lines U and U' are separated by a spacer pad P which may be made of rubber or other suitable material. Although not shown, the spacer pad P could be attached to the flexible strap 110 to prevent loss and to maintain proper orientation during installation. The remainder of the installation procedures are the same as described above.

The stand-off assembly 10 of the present invention is lightweight and easy to assemble and install. A typical stand-off assembly 10 according to the present invention weighs approximately four pounds while other types of stand-off assemblies presently in use weigh approximately 3 to 5 times this amount. This reduction in weight reduces the amount of flotation foam required for the marine riser assembly and also reduces the associated flotation foam cost.

Having described the invention above, various modifications of the techniques, procedures, material and equipment will be apparent to those in the art. It is intended that all such variations within the scope and spirit of the appended claims be embraced thereby.

What is claimed is:

1. A stand-off assembly comprising:

a first stand-off component;

a second stand-off component connected to said first stand-off component, each of said stand-off components comprising:

a bar having first and second ends, said first end including an outturned bend portion, said outturned bend portion connecting to a first arcuate portion, a first leg portion extending outwardly from said first arcuate portion and an attachment upright extending from said first leg portion, a second leg portion extending from said attachment upright, a second arcuate portion connecting to said second leg portion, said second arcuate portion having substantially the same shape as said first arcuate portion and an eyelet connecting to said second arcuate portion at said second end.

2. The stand-off assembly of claim 1, wherein said outturned bend portion from said first stand-off component is inserted through said eyelet of said second stand-off component, and said outturned bend portion of said second stand-off component is inserted through said eyelet of said first stand-off component.

3. The stand-off assembly of claim 1, wherein each of said arcuate portions is a radial arc of less than 180°.

4. The stand-off assembly of claim 1, wherein each of said stand-off components are identical.

5. The stand-off assembly of claim 1, wherein said bar is a round bar.

6. A stand-off assembly adapted to attach to a cylindrical support member, the stand-off assembly comprising:

a first stand-off component having a first arcuate portion adapted to conform to an outer surface of the cylindrical support member, said first stand-off component having a first attachment upright; and a second stand-off component having a second arcuate portion adapted to conform to the outer surface of the cylindrical support member, said second stand-off component having a second attachment upright, wherein said second stand-off component is connected to said first stand-off component.

7. The stand-off assembly of claim 6, wherein said second stand-off component is connected to said first stand-off component with a hinge connection.

8. The stand-off assembly of claim 6, wherein said first stand-off component is identical to said second stand-off component.

9. The stand-off assembly of claim 6, wherein each of said first and second arcuate portions are radial arcs of less than 180°.

10. The stand-off assembly of claim 6, wherein said first and second arcuate portions in combination extend substantially around the cylindrical support member and said first and second attachment uprights are parallel but separated from each other when said first and second arcuate portions are extended substantially around the cylindrical support member.

11. The stand-off assembly of claim 6, further comprising a band clamp extending around said first and second stand-off components and drawing said first and second attachment uprights toward each other.

12. The stand-off assembly of claim 6, wherein said first and second stand-off components are made from round bar.

* * * * *